United States Patent [19]

Orzel et al.

[11] Patent Number: 5,048,493

[45] Date of Patent: Sep. 17, 1991

[54] SYSTEM FOR INTERNAL COMBUSTION ENGINE

[75] Inventors: Daniel V. Orzel, Westland; Martin F. Davenport, Plymouth; Douglas R. Hamburg, Birmingham, all of Mich.

[73] Assignee: Ford Motor Company, Dearborn, Mich.

[21] Appl. No.: 620,685

[22] Filed: Dec. 3, 1990

[51] Int. Cl.[5] ..... F02D 41/04; F02M 25/08

[52] U.S. Cl. ..... 123/489; 123/520

[58] Field of Search ..... 123/440, 489, 518, 519, 123/520

[56] References Cited

U.S. PATENT DOCUMENTS

| | | | |
|---|---|---|---|
| 4,467,769 | 8/1984 | Matsumura | 123/489 |
| 4,641,623 | 2/1987 | Hamburg | 123/518 |
| 4,677,956 | 7/1987 | Hamburg | 123/489 X |
| 4,715,340 | 12/1987 | Cook et al. | 123/406 |
| 4,741,318 | 5/1988 | Kortge et al. | 123/520 |
| 4,748,959 | 6/1988 | Cook et al. | 123/520 |
| 4,867,126 | 9/1989 | Yonekawa et al. | 123/520 |
| 4,961,412 | 10/1990 | Furuyama | 123/520 |
| 4,967,713 | 11/1990 | Kojima | 123/520 X |

FOREIGN PATENT DOCUMENTS

| | | | |
|---|---|---|---|
| 0219863 | 9/1988 | Japan | 123/520 |

*Primary Examiner*—Willis R. Wolfe

*Attorney, Agent, or Firm*—Allan J. Lippa; Peter Abolins

[57] ABSTRACT

A system and method for controlling operation of an engine having a fuel vapor recovery system coupled between a fuel supply system and engine air/fuel intake. In response to a two-state exhaust gas oxygen sensor (EGO sensor), a feedback controller generates a desired fuel charge. This feedback controller is also responsive to an adaptive learning controller which provides corrections for long term air/fuel offsets caused by such factors as fuel injector variances. An adaptive fuel vapor learning controller measures fuel vapor concentration during purging operations of the fuel vapor recovery system. This adaptive fuel vapor learning controller provides a fuel vapor correction factor which is subtracted from the desired fuel charge to maintain proper air/fuel ratio operation during a fuel vapor purge. Purging operations are disabled when the measurement of fuel vapor concentration is below a preselected value. At that time, the offset learning controller is enabled for a preselected time. Purging operations occur until the learned measurement of fuel vapor content indicates purging is no longer necessary. Thereafter, adaptive offset learning is enabled for a preselected time. After such preselected time, adaptive offset learning is disabled, purging operations recommenced, and adaptive vapor learning also reinitiated.

13 Claims, 6 Drawing Sheets time
$t_1$
RICH
LEAN
EGO
$t_2$
$t_3$
$t_4$
$t_5$
$t_6$
$t_7$
Pfd
Pf
LAMBSE
PCOMP
$t_8$

SYSTEM FOR INTERNAL COMBUSTION ENGINE

BACKGROUND OF THE INVENTION

The field of the invention relates to air/fuel ratio control for motor vehicles having a fuel vapor recovery system coupled between the fuel supply system and the air/fuel intake of an internal combustion engine.

Feedback control systems responsive to an exhaust gas oxygen sensor are commonly employed to maintain the engine's air/fuel ratio at a desired value. Typically, a two-state exhaust gas oxygen sensor is utilized which provides an output signal having either a high voltage state or a low voltage state when the engine is operating on the rich side or lean side, respectively, of the desired air/fuel ratio. This output signal is usually integrated to provide a measurement of average air/fuel ratio which is then used as a feedback variable for regulating fuel delivered to the engine.

It is also known to generate a second feedback variable for correcting engine conditions which may cause permanent or long term air/fuel ratio offsets. For example, a fuel injector having an oversized orifice will provide a continuous air/fuel offset in the rich direction. Rather than have the first feedback variable continuously correcting for such offsets, a second feedback variable is generated in response to the overall offset of the first feedback variable. Delivered fuel is then corrected in response to both feedback variables.

Air/fuel ratio control has been complicated by the addition of fuel vapor recovery systems to motor vehicles. To reduce emissions of gasoline vapors into the atmosphere, as required by government emission standards, fuel vapor recovery systems are commonly utilized. These systems store excess fuel vapors emitted from the fuel tank in a canister having activated charcoal or other hydrocarbon absorbing material. To replenish the canister storage capacity, air is periodically purged through the canister, absorbing stored hydrocarbons, and the mixture of vapors and purged air inducted into the engine. Concurrently, vapors are inducted directly from the fuel tank into the engine.

A prior approach to air/fuel feedback control for an engine which is coupled to a fuel vapor recovery system is disclosed in U.S. Pat. No. 4,467,769 issued to Matsumura. Delivered fuel is adjusted in accordance with two feedback variables. The first feedback variable, an integration correction amount, is derived from the output signal of an exhaust gas oxygen sensor. A learning correction amount is then generated as a second feedback variable from the integration correction amount during steady-state engine operations. This learning correction amount is utilized to compensate for long-term or permanent air/fuel ratio offsets caused by engine operation. When steady-state engine operation is indicated by comparing measurements of inducted airflow and other engine operating parameters, a learning correction amount is provided and stored as a function of mass airflow. Stated another way, during steady-state engine operation, a look-up table is generated of inducted airflow versus learning correction values. In addition, when the engine is detected as being in steady-state operation, the fuel vapor recovery system is disabled to facilitate the learning operation.

The inventors herein have recognized several disadvantages of the above approaches. For example, disabling fuel vapor recovery whenever the engine is at steady-state operation may result in excessive emission of fuel vapors into the atmosphere and over-pressurization of the fuel system. This disadvantage may be particularly troublesome during highway cruising when the engine is at steady-state operation for a long period of time. In addition, tighter government regulations governing hydrocarbon emissions in the near future will cause such approaches to become particularly troublesome.

SUMMARY OF THE INVENTION

An object of the invention described herein is to provide induction of purged fuel vapors whenever such purging is required with minimal effect on the engine's air/fuel operation.

The above object and others are achieved, and disadvantages of prior approaches overcome, by providing both a control system and method for controlling air/fuel operation of an engine which inducts fuel vapors from a fuel vapor recovery system. In one particular aspect of the invention, the control system comprises: induction means for inducting a mixture of ambient air and liquid fuel into the air/fuel intake; purging means coupled to the fuel supply system and the fuel vapor recovery system for periodically purging a vapor mixture of fuel vapor and purged air into the engine air/fuel intake; adaptive learning means responsive to an air/fuel measurement of engine operation for measuring fuel vapor content in the purged vapor mixture when the adaptive learning means is in a first state of operation and for measuring air/fuel offsets over a range of engine operating conditions when the adaptive learning means is in a second state of operation, the adaptive learning means switching from the first state to the second state when the measurement of fuel vapor content is less than a preselected value; feedback means coupled to an exhaust gas oxygen sensor for providing the air/fuel measurement, the feedback means also correcting the liquid fuel inducted into the engine in response to the air/fuel measurement and the fuel vapor content measurement and the air/fuel offset measurement; and purge control means for stopping the purging when the fuel vapor content measurement is less than the preselected value and for initiating the purging after the purging has been stopped for the preselected time.

An advantage of the above aspect of the invention is that purging occurs until the measurement of fuel vapors indicates that purging is no longer required. At that time, adaptive learning of the air/fuel offsets is commenced. Accordingly, fuel vapor purging occurs whenever it is necessary, whereas, prior approaches disabled purging during steady-state engine operation in order to accomplish adaptive learning of air/fuel offsets. Another advantage is that adaptive learning of fuel vapor compensation enables correction of air/fuel ratio for purged fuel vapors without affecting the feedback means range of operating authority. Unlike the invention herein, prior approaches utilized the same air/fuel feedback control to correct for both inducted fuel vapors and variations in engine air/fuel ratio caused by other factors. Accordingly, such feedback systems corrections for fuel vapor purging limited the systems ability to correct for air/fuel ratio variations.

BRIEF DESCRIPTION OF THE DRAWINGS

The object and advantages of the invention described above and others will be more clearly understood by reading an example of an embodiment in which the invention is used to advantage, referred to herein as the Preferred Embodiment, with reference to the attached drawings wherein.

DESCRIPTION OF THE PREFERRED EMBODIMENT

Figure 1:
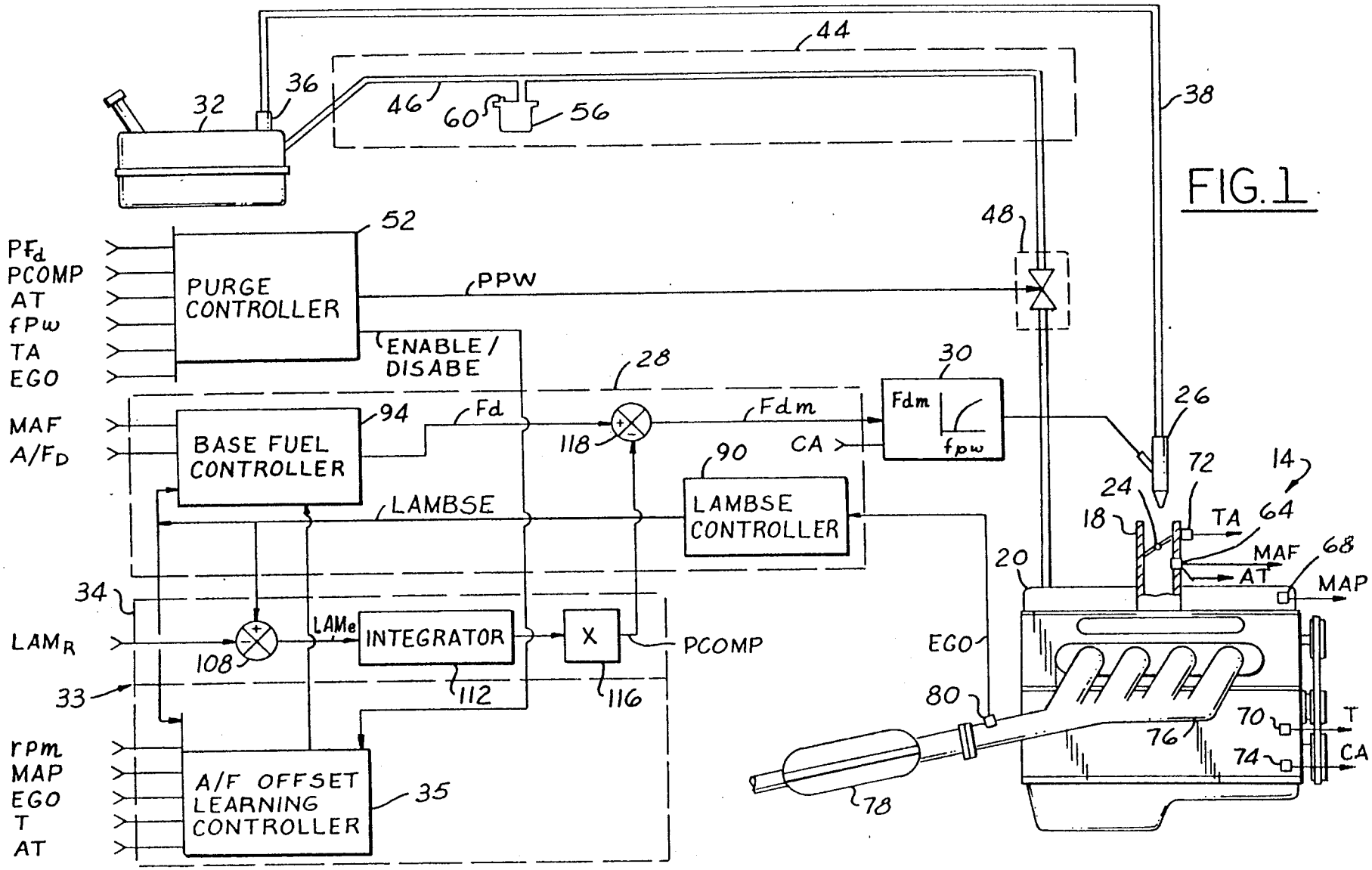
FIG. 1 is a block diagram of an embodiment wherein the invention is used to advantage.

Referring first to FIG. 1, engine 14 is shown as a central fuel injected engine having throttle body 18 coupled to intake manifold 20. Throttle body 18 is shown having throttle plate 24 positioned therein for controlling the induction of ambient air into intake manifold 20. Fuel injector 26 injects a predetermined amount of fuel into throttle body 18 in response to fuel controller 30. As described in greater detail later herein, fuel controller 30 is controlled by both air/fuel feedback system 28 and adaptive learning controller 33 which includes fuel vapor learning controller 34 and offset learning controller 35. Fuel is delivered to fuel injector 26 by a conventional fuel system including fuel tank 32, fuel pump 36, and fuel rail 38.

Fuel vapor recovery system 44 is shown coupled between fuel tank 32 and intake manifold 20 via purge line 46 and purge control valve 48. In this particular example, fuel vapor recovery system 44 includes vapor purge line 46 connected to fuel tank 32 and canister 56 which is connected in parallel to fuel tank 32 for absorbing fuel vapors therefrom by activated charcoal contained within the canister. For reasons described later herein, purge control valve 48 is controlled by purge rate controller 52 to maintain a substantially constant flow of vapors therethrough regardless of the rate of air inducted into throttle body 18 or the manifold pressure of intake manifold 20. In this particular example, valve 48 is a pulse width actuated solenoid valve having constant cross-sectional area. A valve having a variable orifice may also be used to advantage such as a control valve supplied by SIEMENS as part no. F3DE-9C915-AA.

During fuel vapor purge, air is drawn through canister 56 via inlet vent 60 absorbing hydrocarbons from the activated charcoal. The mixture of purged air and absorbed vapors is then inducted into intake manifold 20 via purge control valve 48. Concurrently, fuel vapors from fuel tank 32 are drawn into intake manifold 20 via purge control valve 48.

Conventional sensors are shown coupled to engine 14 for providing indications of engine operation. In this example, these sensors include mass airflow sensor 64 which provides a measurement of mass airflow (MAF) inducted into engine 14 and air temperature (AT) of the inducted airflow. Manifold pressure sensor 68 provides a measurement (MAP) of absolute manifold pressure in intake manifold 20. Temperature sensor 70 provides a measurement of engine operating temperature (T). Throttle angle sensor 72 provides throttle position signal TA. Engine speed sensor 74 provides a measurement of engine speed (rpm) and crank angle (CA).

Engine 14 also includes exhaust manifold 76 coupled to conventional three-way ($NO_X$, CO, HC) catalytic converter 78. Exhaust gas oxygen sensor 80, a conventional two-state oxygen sensor in this example, is shown coupled to exhaust manifold 76 for providing an indication of air/fuel ratio operation of engine 14. More specifically, exhaust gas oxygen sensor 80 provides a signal having a high state when air/fuel ratio operation is on the rich side of a predetermined air/fuel ratio commonly referred to as stoichiometry (14.7 lbs. air/lb. fuel in this particular example). When engine air/fuel ratio operation is lean of stoichiometry, exhaust gas oxygen sensor 80 provides its output signal at a low state.

Air/fuel feedback system 28 is shown including LAMBSE controller 90 and base fuel controller 94. LAMBSE controller 90, a proportional plus integral controller in this particular example, integrates the output signal from exhaust gas oxygen sensor 80. The output control signal (LAMBSE) provided by LAMBSE controller 90 is at an average value of unity when engine 14 is operating at stoichiometry and there are no steady-state air/fuel errors or offsets. For a typical example of operation, LAMBSE ranges from 0.75–1.25.

Base fuel controller 94 provides desired fuel charge signal Fd as shown by the equation below. It is seen that signal MAF is divided by both LAMBSE and the reference or desired air/fuel ratio ($A/F_D$) such as stoichiometry. This ratio is then multiplied by the appropriate offset signal ($O_i$) from offset learning controller 35. During open loop operation, such as when engine 14 is cool and corrections from exhaust gas oxygen sensor 80 are not desired, signal LAMBSE is forced to unity.

$$Fd = \frac{MAF * O_i}{LAMBSE * A/F_D}$$

As described in greater detail later herein with particular reference to FIG. 5, offset learning controller 35 provides corrections for long-term or permanent offsets in engine air/fuel operation caused by operating factors such as, for example, fuel injector variances. In general, when signal LAMBSE is offset in either a rich or a lean direction for a predetermined time, the offset is gradually learned and corresponding correction factors ($O_i$) are generated. These correction factors are stored in a map or table engine speed and load cells. Each offset correction factor ($O_i$) is stored in the speed/load cell most closely correlated with engine speed and load operation during calculation of a particular offset correction factor ($O_i$) When signal Fd is calculated by base fuel controller 94, an appropriate offset correction factor $O_i$ is addressed from its memory location by the engine speed at load conditions existing at that time.

Continuing with FIG. 1, fuel vapor learning controller 34 provides output signal PCOMP which is essentially a measurement of the mass flow of fuel vapors into intake manifold 20 during purge operation. More specifically, reference signal $LAM_R$, unity in this particular example, is subtracted from signal LAMBSE to generate error signal $LAM_e$. Integrator 112 integrates signal $LAM_e$ and provides an output to multiplier 116 for multiplication by a preselected scaling factor to provide signal PCOMP. Fuel vapor learning control system 34 is therefore a feedback air/fuel ratio controller responsive to fuel vapor purging and having a slower response time than air/fuel feedback system 28.

The resulting signal PCOMP from vapor learning control system 34 is subtracted from desired fuel signal Fd in summer 118 to generate a modified desired fuel charge signal (Fdm). Fuel controller 30 converts signal Fdm into signal fpw having a pulse width directly correlated to the voltage level of signal Fdm. Fuel injector 26 is actuated during the pulse width of signal fpw such that the desired amount of fuel is metered into engine 14 for maintaining the desired air/fuel ratio ($A/F_D$).

Those skilled in the art will recognize that the operations described for air/fuel feedback system 28 and adaptive learning controller 33 may be performed by a microcomputer in which case the functional blocks shown in FIG. 1 are representative of program steps. These operations may also be performed by discrete IC's or analog circuitry.

An example of operation of the embodiment shown in FIG. 1, and fuel fuel vapor learning controller 34 in particular, is described with reference to operating conditions illustrated in FIGS. 2A–2H. For ease of illustration, zero propagation delay is assumed for an air/fuel charge to propagate through engine 14 to exhaust gas oxygen sensor 80. Propagation delay of course is not zero, but may be as high as several seconds. Any propagation delay would further dramatize the advantages of the invention herein over prior approaches.

Steady-state engine operation is shown before time $t_1$ wherein inducted airflow, as represented by signal MAF, is at steady-state, signal LAMBSE is at an average value of unity, purge has not yet been initiated, and the actual engine air/fuel ratio is at an average value of stoichiometry (14.7 in this particular example).

Figure 2A:
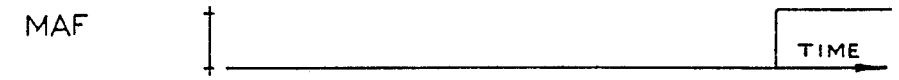
FIGS. 2A–2H illustrate various electrical waveforms associated with the block diagram shown in FIG. 1.
Figure 2B:
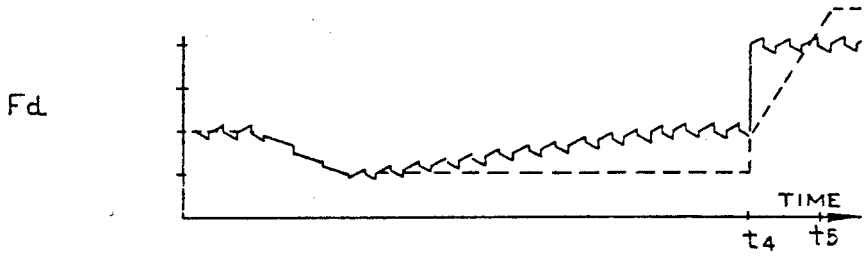
Figure 2C:
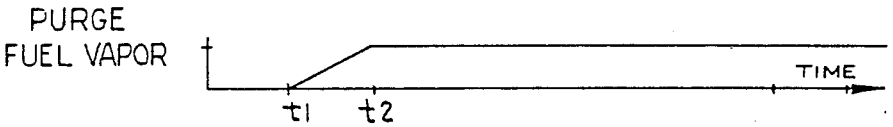

Referring first to FIG. 2C, vapor purge is initiated at time $t_1$. As described in greater detail later herein with particular reference to FIG. 3 and FIGS. 4A–4E, the rate of purge flow is gradually increased until it reaches the desired value at time $t_2$. For this particular example, the desired rate of purge flow is a maximum wherein the duty cycle of signal ppw is 100%. Since the inducted mixture of air, fuel, purged fuel vapor, and purged air becomes richer as the purge flow is turned on, signal LAMBSE will gradually increase as purged fuel vapors are being inducted as shown between times $t_1$ and $t_2$ in FIG. 2D. In response to this increase in signal LAMBSE, base fuel controller 94 gradually decreases desired fuel charge signal Fd as shown in FIG. 2B such that the overall actual air/fuel ratio of engine 14 remains, on average, at 14.7 (see FIG. 2H). Stated another way, fuel delivered is decreased as fuel vapor is increased to maintain the desired air/fuel ratio.

Figure 2D:
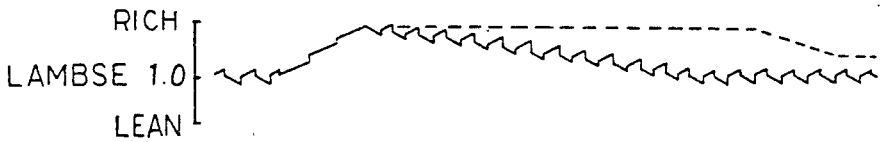
Figure 2E:
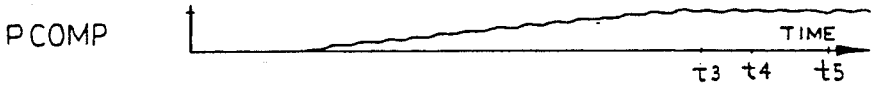
Figure 2F:
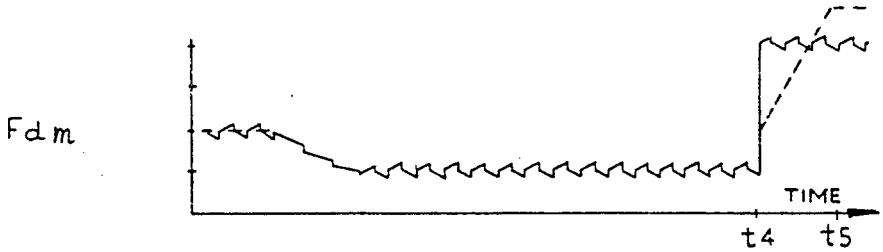

Referring to FIGS. 2D and 2E, fuel vapor learning controller 34 provides signal PCOMP at a gradually increasing value as signal LAMBSE deviates from its reference value of unity. More specifically, as previously discussed herein, signal PCOMP is an integral of the difference between signal LAMBSE and its reference value of unity. It is seen that as signal PCOMP increases, the liquid fuel delivered (Fdm) to engine 14 is decreased such that signal LAMBSE is forced downward until an average value of unity is achieved at time $t_3$. At this time signal PCOMP reaches the value corresponding to the amount of purged fuel vapors.

Accordingly, fuel vapor learning controller 34 adaptively learns the concentration of purged fuel vapors during a purge and compensates the overall engine air/fuel ratio for such purged fuel vapors. The operating range of authority of air/fuel feedback system 28 is therefore not reduced during fuel vapor purging. Other perturbations in engine air/fuel ratio caused by factors other than purged fuel vapors, such as perturbations in inducted airflow, are corrected by base fuel controller 94 in response to signal LAMBSE.

Figure 2G:
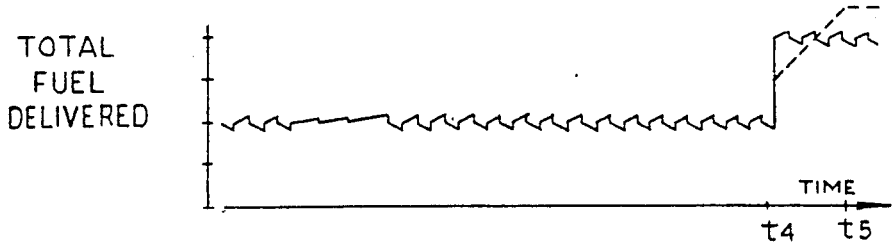

Referring to FIG. 2B and continuing with FIGS. 2D and 2E, it is seen that desired fuel signal Fd provided by base fuel controller 94 increases in correlation with a decrease in signal LAMBSE until, at time $t_3$, signal Fd reaches its value before introduction of purging. However, referring to FIG. 2F, modified desired fuel signal Fdm reaches a steady-state value commencing at time $t_2$ by operation of signal PCOMP (i.e., Fdm = Fd - PCOMP) such that the total fuel delivered to the engine (injected fuel plus purged fuel vapors) remains substantially constant before and during purging operation as shown in FIG. 2G. Fuel vapor learning controller 34 therefore essentially measures the amount of fuel vapors inducted during purging operations as previously discussed. And base fuel controller 94 generates a desired fuel charge signal Fd representative of fuel required to maintain the desired engine air/fuel ratio independently of purging operations.

The illustrative example continues under conditions where the engine throttle, and accordingly inducted airflow (MAF), are suddenly changed as shown at time $t_4$ in FIG. 2A. Since the rate of purge flow is maintained substantially constant, signal PCOMP remains at a substantially constant value despite the sudden change in inducted airflow (see FIG. 2E). Correction for the lean offset provided by the sudden increase in inducted airflow will then be provided by base fuel controller 94 (as described previously herein and as further illustrated in FIGS. 2B, 2F, and 2G, and 2H). On the other hand, without operation of fuel vapor control 34, a transient in engine air/fuel ratio would result with any sudden increase in throttle angle. This, as previously discussed, is indicative of prior feedback approaches.

Figure 2H:
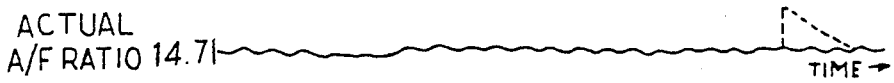

To illustrate the above problem, dashed lines are shown in FIGS. 2B, 2D, 2F, 2G, and 2H which are illustrative of operation without fuel vapor control system 34 and its output signal PCOMP. It is seen that the sudden change in airflow at time $t_4$ causes a lean perturbation in air/fuel ratio until signal LAMBSE provides a correction at time $t_5$. This perturbation occurs because base fuel controller 94 initially offsets desired fuel charge Fd in response to the increase in signal MAF (i.e., Fd = MAF/14.7*LAMBSE). The overall air/fuel mixture is now leaner than before time $t_4$ because purge vapor flow has not increased in proportion to the increase in inducted airflow. LAMBSE controller 90 will detect this lean offset during the time interval from $t_4$ through $t_5$ and base fuel controller 94 will appropriately adjust the fuel delivered by time $t_5$. However, an air/fuel transient would occur between times $t_4$ and $t_5$ as shown in FIG. 2H due to the response time of LAMBSE controller 90.

Figure 3A:
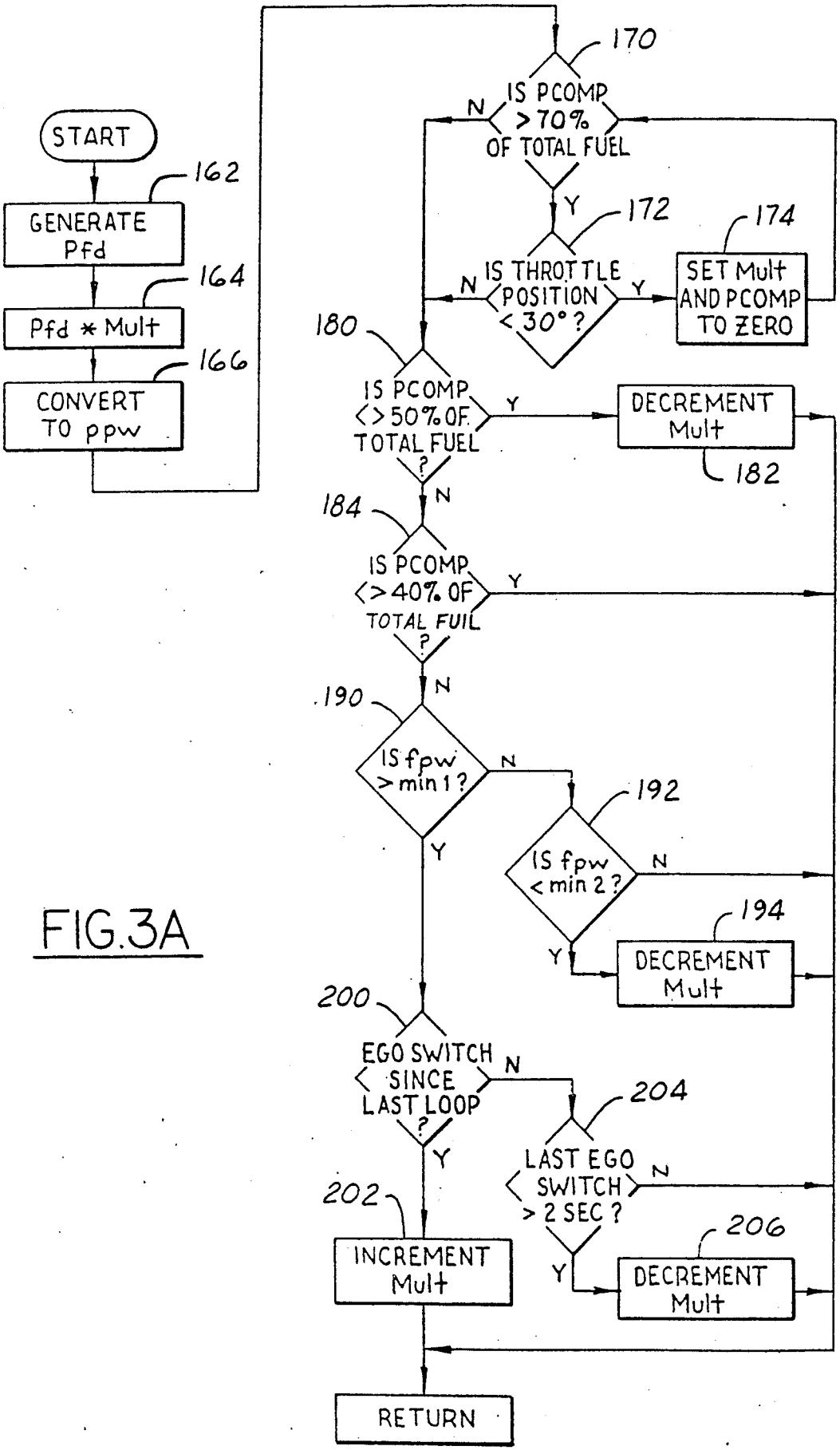
FIGS. 3A and 3B are high level flowcharts illustrating various program steps performed by a portion of the embodiment illustrated in FIG. 1.

Operation of purge rate controller 52 is now described in more detail with reference to FIGS. 3A–3B and FIGS. 4A–4E. Referring first to FIG. 3A, desired purge flow signal Pfd is generated during step 162 after initiation of purging operation which is described later herein with particular reference to FIG. 3B. During step 164, signal Pfd is multiplied by a multiplier factor shown as signal Mult. As described in greater detail below, signal Mult is incremented in predetermined steps to a maximum and desired value of unity for controlling the turn on of purge flow. The product Pfd * Mult is converted to the corresponding pulse width modulated signal ppw in step 166. For example, if signal Mult is 0.5, signal ppw is generated with a 50% duty cycle.

During steps 170–174, purge is disabled under sudden deceleration conditions when there is an appreciable fuel vapor concentration to prevent temporary drivability problems. More specifically, a determination of whether fuel vapors comprise more than 70% of total fuel (fuel vapor plus liquid fuel) is made during step 170. In this particular example, signal PCOMP is divided by the sum of signal Fd plus signal PCOMP. If this ratio is greater than 70%, and the throttle position is less than 30° (see step 172), then purge is disabled by setting signal Mult and signal PCOMP to zero (see step 174). However, if the ratio PCOMP/(Fdm + PCOMP) is less than 70%, or throttle position is greater than 30°, the process continues with step 180.

During steps 180 and 182, signal Mult is decremented a predetermined amount if the fuel vapor contribution of total fuel is greater than 50%. When less than 50%, but greater than 40%, the program is exited without further changes to signal Mult (see step 184) such that the rate of purge flow remains the same. When fuel vapor concentration is less than 40% of total fuel, the program advances to step 190. It is noted that the functions performed by steps 180–184 may be accomplished by other means. For example, a simple comparison of signal PCOMP to various preselected values may also be used to advantage for either decrementing purge flow during initiation of purging operations, or holding it constant when there are high concentrations of fuel vapors.

During step 190, fuel injector pulse width signal fpw is compared to a first minimum value (minl) which defines an upper level of a pulse width dead band. If signal fpw is greater than minl, processing continues with program step 200. On the other hand, when signal fpw is less than minl, but greater than a minimum pulse width associated with the lower level of such dead band (min2), the rate of purge flow is not altered and the program exited (see step 192). However, when signal fpw is less than min2, the rate of purge flow is decremented a predetermined amount by decrementing signal Mult a corresponding predetermined amount (see steps 192 and 194).

When fuel injector pulse width signal fpw is above the dead band (i.e., greater than min1) the program continues with steps 200–206 for increasing the rate of purge flow. Signal Mult is incremented a predetermined amount when exhaust gas oxygen sensor 80 (hereinafter referred to as EGO) has switched states since the last program background loop (see steps 200 and 202). If there has not been an EGO switch during a predetermined time, such as two seconds, signal Mult is decremented by a predetermined amount (see steps 204 and 206). However, if there has been an EGO switch during such predetermined time, the rate of purge flow remains the same (see step 204). Accordingly, during initiation of the purging process, the rate of purge flow is gradually increased with each change in state of exhaust gas oxygen sensor 80. In this manner, purge flow is turned on at a gradual rate to its maximum value (i.e., signal Mult incremented to unity) when indications (EGO switching) are provided that air/fuel feedback system 28 and fuel vapor control system 34 are properly compensating for purging of fuel vapors.

The above operation may be more clearly understood by reviewing the illustrative example presented in FIGS. 4A–4E. For ease of illustration, zero propagation delay of an air/fuel charge through the engine is assumed. An enable purge command is shown provided at time $t_1$ by purge rate controller 52 in FIG. 4A. Exhaust gas oxygen sensor 80 is shown cycling between the rich side and lean side of stoichiometry before time $t_1$ indicating that the average air/fuel ratio is at stoichiometry. At time $t_2$ exhaust gas oxygen sensor 80 is shown switching rich, and signal Mult is increased a predetermined amount by purge rate controller 52 as previously described. In response, purge valve 48 is modulated by signal ppw such that purge flow begins at time $t_2$ (see FIG. 4C).

Figures 4A, 4B, 4C, 4D, 4E:
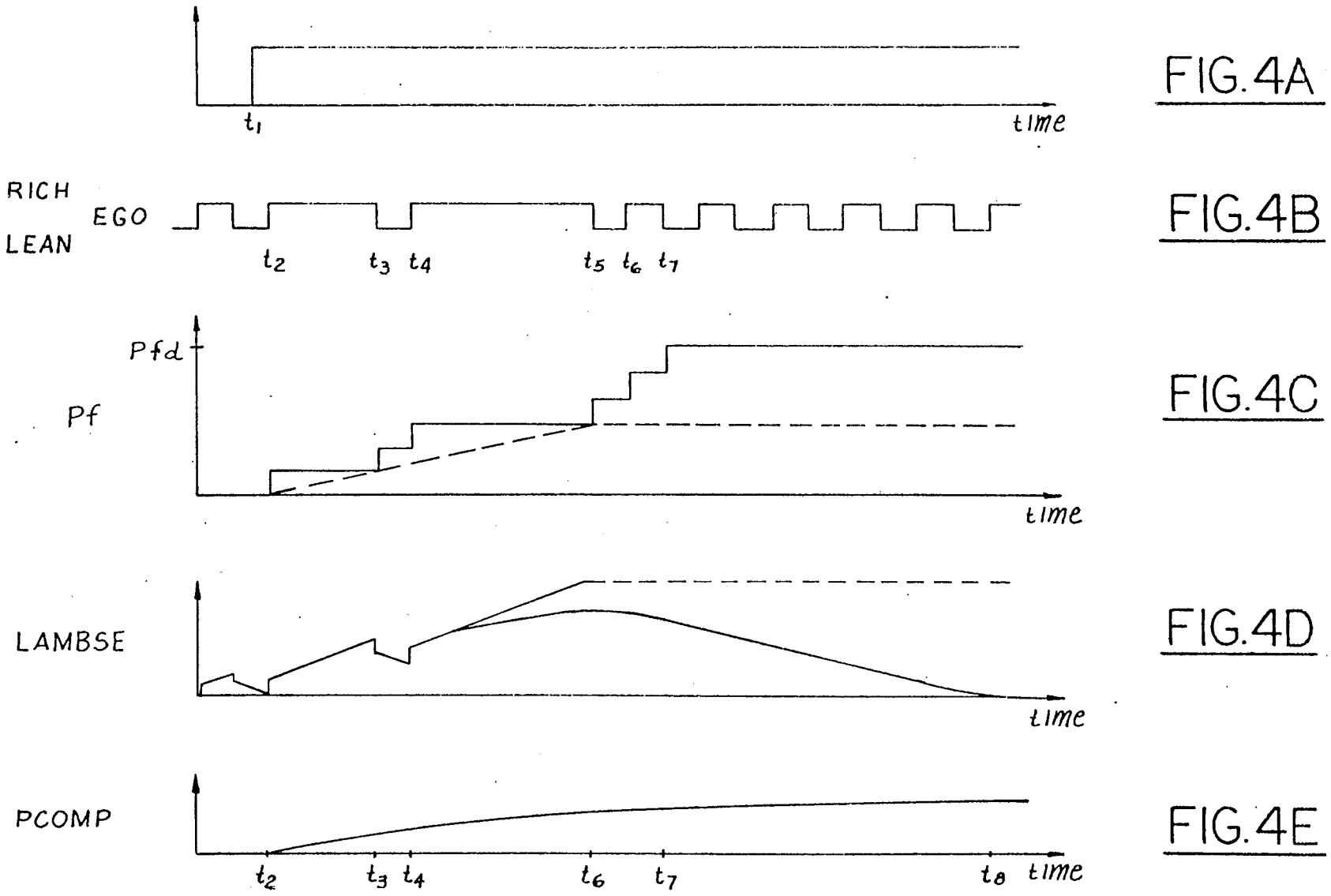
FIGS. 4A–4E are a graphical representation in accordance with the flowcharts shown in FIGS. 3A-3B.

The corresponding proportional plus integral operation of signal LAMBSE is shown in FIG. 4D. Signal LAMBSE is shown first jumping upward due to its proportional term and then integrating upward after exhaust gas oxygen sensor 80 has switched at time $t_2$ In response, signal PCOMP is shown increasing as signal LAMBSE deviates from its reference value of unity.

At time $t_3$, exhaust gas oxygen sensor 80 is shown switching lean in response to correction of delivered liquid fuel by both signal LAMBSE and signal PCOMP (see FIG. 4B). In response, purge flow is again incremented a predetermined amount. This operation continues with exhaust gas oxygen sensor switching at times $t_4$, $t_5$, $t_6$, and $t_7$ until the maximum rate of purge flow is achieved (i.e., signal ppw at 100% duty cycle).

As previously described herein, with particular reference to fuel vapor control system 34, signal PCOMP adaptively learns the deviation in air/fuel ratio caused by induction of rich fuel vapors and forces signal LAMBSE back to its value before introduction of purge as shown at time $t_8$ in FIGS. 4D and 4E. Accordingly, air/fuel feedback system 28 then has a full operating range of authority during purge operations unlike prior approaches. For illustrative purposes, operation indicative of prior approaches is shown by dashed lines in FIGS. 4C and 4D. The particular prior approaches indicated, which did not have any function similar to fuel vapor learning controller 34, inhibited the rate of purge flow when signal LAMBSE (or its functional equivalent) reached a value corresponding to the operating range of authority of the air/fuel feedback system. This limit is illustrated at time $t_5$ in FIGS. 4C and 4D. Accordingly, such prior approaches did not maximize purge flow as does the invention described herein. A disadvantage of these prior approaches was unnecessary emission of hydrocarbons into the atmosphere.

Figure 3B:
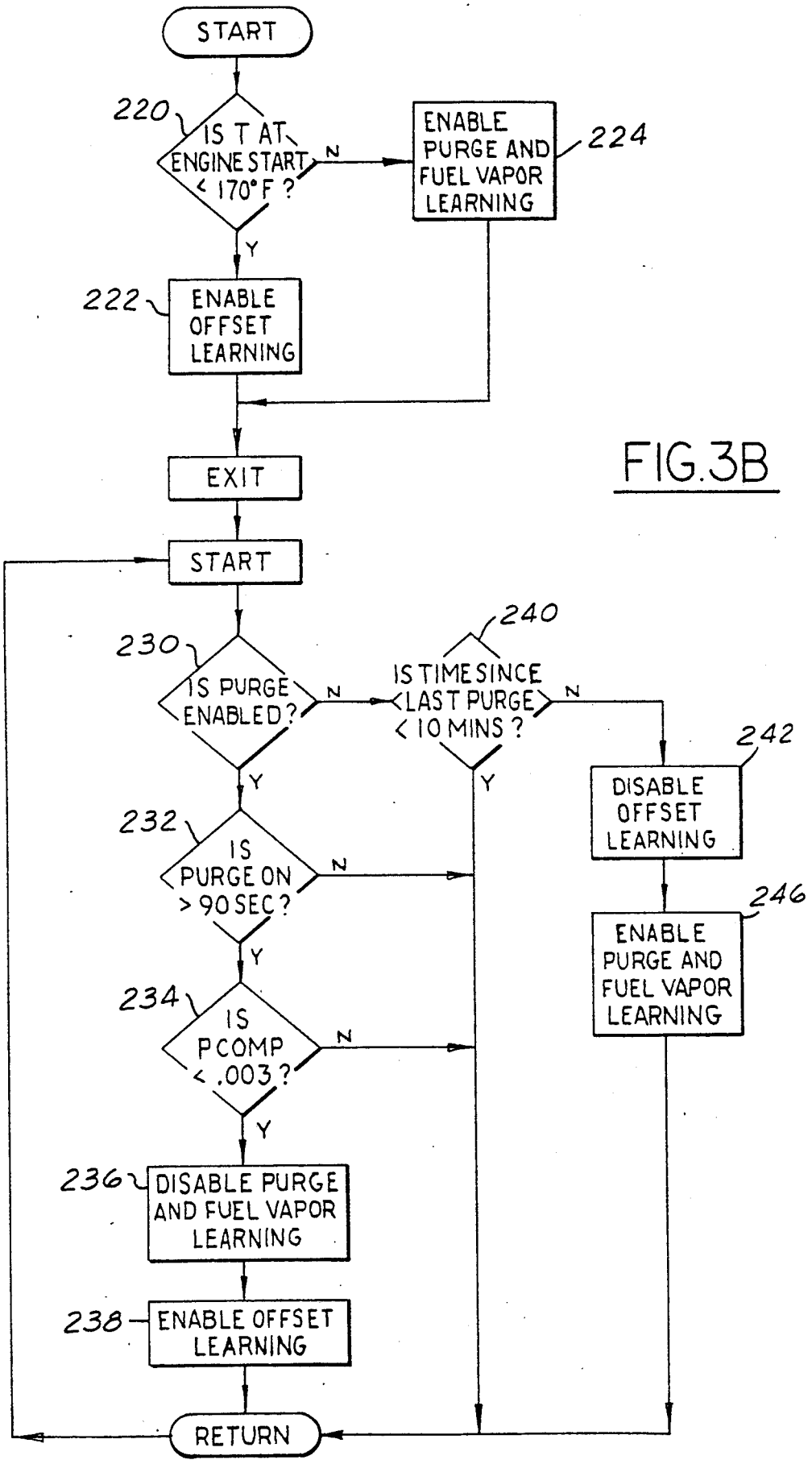

Purge controller 52 also enables offset learning operations as now described with reference to FIG. 3B. After engine 14 is started, engine coolant temperature signal T is compared to a preselected value, shown as 170° F. in this particular example. When engine temperature is less than such preselected value, offset learning is enabled as shown in step 222 and described in more detail later herein with particular reference to FIG. 5. On the other hand, when engine temperature is greater than such preselected value, both fuel vapor purge and ful vapor learning are enabled as shown in step 224. Accordingly, when engine coolant temperature indicates that fuel vapors may be present, fuel vapor purge is promptly enabled. It is noted that program steps 220–224 are sequenced after engine start-up. During engine operation, program steps 230–246 are sequenced as described below.

When purge is enabled (see step 230), and it has been on for more than a predetermined time, shown in this example as 90 seconds (see step 232), then signal PCOMP is compared to a preselected value here shown as 0.003 lbs/min (see step 234). When signal PCOMP is less than the preselected value, indicating that fuel vapor content is relatively low, purge and fuel vapor learning are disabled as shown in step 236. Purge is disabled by setting signal Mult to zero such that corresponding signal ppw which activates solenoid valve 48 is also at a zero level. Similarly, fuel vapor learning controller 34 is disabled by setting the scaling factor in multiplier 116 to zero such that signal PCOMP is forced to zero. After purging operations and fuel vapor learning operations are disabled, offset learning operations performed by offset learning controller 35 are enabled as shown in step 238.

Returning back to step 230, when purge has not been enabled, a determination of whether purge has occurred during the preceding 10 minutes, or other preselected time, is made during step 240. If purging operations have not occurred during such preselected time, offset learning is disabled (see step 242). Thereafter, purging operations and fuel vapor learning is enabled as shown in step 246.

In accordance with the above program steps, purging operations are discontinued whenever fuel vapor learning controller 34 indicates that fuel vapor content is less than a preselected value. In response, offset learning operations performed by offset learning controller 35 are enabled. And whenever purge operations are disabled for more than a predetermined time, offset learning is disabled and purge operations enabled. Thus, purging operations occur until a learned measurement of fuel vapor content indicates such purging is no longer necessary. Thereafter, fuel vapor content is sampled at preselected time intervals and purging reinitiated whenever the learned measurement of fuel vapor content indicates purging is required. Other than cold engine start-up conditions, offset learning operations occur only when the learned measurement of fuel vapor content indicates that fuel vapor purging is not required.

Figure 5:
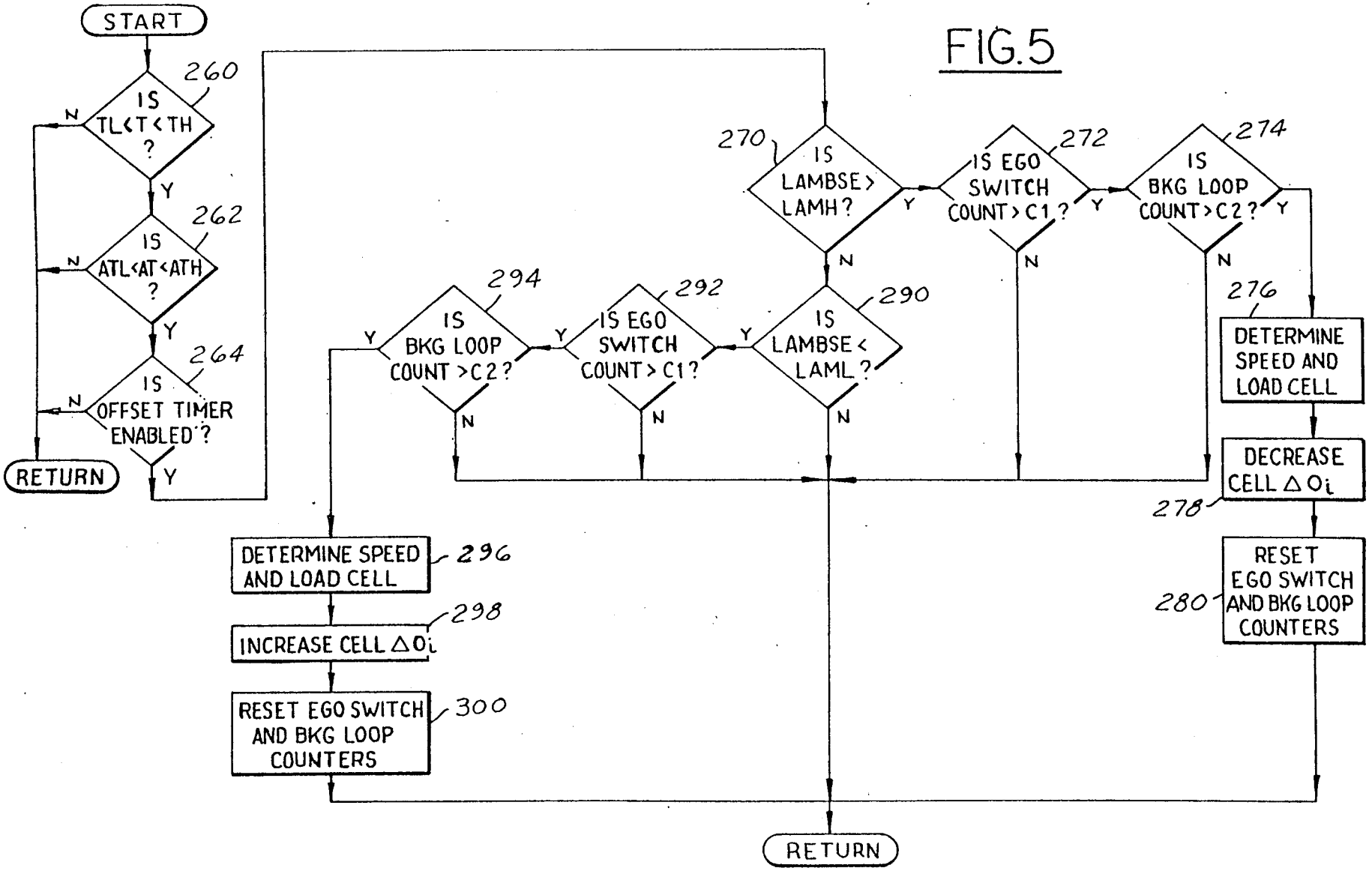
FIG. 5 is a high level flowchart illustrating various program steps performed by a portion of the embodiment illustrated in FIG. 1.

Operation of offset learning controller 35 is now described with particular reference to the program steps shown in FIG. 5. When engine coolant temperature signal T is within a predetermined operating temperature range (see step 260) and inducted airflow temperature signal AT is also within a predetermined temperature operating range (see step 262), an offset timer is enabled (see step 264). the purpose of such offset timer is to provide a time delay or pause after starting engine 14. Thereafter, signal LAMBSE is compared with a preselected upper value (LAMH) as shown in step 270. When signal LAMBSE is greater than such upper limit, program steps 272–280 determine whether the appropriate speed/load cell is decreased by offset correction $\Delta O_i$. More specifically, each change in state of exhaust gas oxygen sensor 80 (EGO switch) is counted. When such count exceeds predetermined count C1, the number of program background loops since the last EGO switch is compared to preselected count C2 during step 274. When both the number of EGO switches and number of background loops have exceeded their respective preselective values, a determination of the engine speed/load cell which is most closely correlated with engine speed and load operation during this program loop is accomplished during step 276. A RAM memory location (not shown) corresponding to such speed/load cell is decreased by offset correction $\Delta O_i$ during step 278. The EGO switch and background loop counters are then reset during step 280.

When signal LAMBSE is less than a preselected lower limit value (LAML) as determined during step 290, program steps 292–300 are then sequenced for increasing the offset correction factor. The operation proceeds in a similar manner to that previously described herein with reference to corresponding program steps 272–280. When both the EGO switch count and background loop count are greater than respective counts C1 and C2 (see steps 292–294, a determination of the appropriate speed/load cell is made during step 296. Such cell is increased by offset correction factor $\Delta O_i$ during step 298. Thereafter, the EGO switch counter and background loop counter are reset.

It is noted that the above described offset learning operations are accomplished only when enabled by purge controller 52 as described previously herein with reference to FIG. 3B. More specifically, offset learning operations are enabled only when engine 14 starts up under cold conditions or when signal PCOMP indicates fuel vapor content is so low that purging operations should be temporarily disabled.

This concludes the description of the Preferred Embodiment. The reading of it by those skilled in the art will bring to mind many modifications and alterations without departing from the spirit of the invention. Accordingly, it is intended that the invention be limited only by the following claims.

What is claimed:

1. A control system for a vehicle having a fuel vapor recovery system coupled between fuel supply system and an intake manifold of an internal combustion engine, comprising:

induction means for inducting a mixture of ambient air and liquid fuel into the air/fuel intake;

purging means coupled to the fuel supply system and the fuel vapor recovery system for periodically purging a vapor mixture of fuel vapor and purged air into the engine air/fuel intake;

adaptive learning means responsive to an air/fuel measurement of engine operation for measuring fuel vapor content in said purged vapor mixture;

feedback means coupled to an exhaust gas oxygen sensor for providing said air/fuel measurement, said feedback means also correcting said liquid fuel inducted into said engine in response to said air/fuel measurement and said fuel vapor content measurement; and purge control means for stopping said purging when said fuel vapor content measurement is less than a preselected value.

2. The control system recited in claim 1 wherein said adaptive learning means is responsive to an integration of a deviation between said air/fuel measurement and a desired air/fuel measurement.

3. The control system recited in claim 1 wherein said purging means further comprises sampling means for periodically sampling said fuel vapor content measurement.

4. A control system for a vehicle having a fuel vapor recovery system coupled between a fuel supply system and an intake manifold of an internal combustion engine, comprising:

purging means coupled to the fuel supply system and the fuel vapor recovery system for periodically purging a vapor mixture of fuel vapor and purged air into the engine air/fuel intake;

feedback means coupled to an exhaust gas oxygen sensor for providing an air/fuel ratio indication of engine operation;

first correction means responsive to said air/fuel ratio indication and a measurement of airflow inducted into the engine for providing a base fuel command;

learning means responsive to a deviation in said air/fuel ratio indication from a desired air/fuel ratio for providing a measurement of fuel vapor content in said purged vapor mixture;

second correction means for subtracting a value related to said fuel vapor content measurement from said base fuel command to form a modified base fuel command and providing delivery of liquid fuel to the engine in relation to said modified base fuel command; and purge control means for stopping said purging and said learning means when said fuel vapor content measurement is less than a preselected value.

5. The control system recited in claim 4 wherein purge control means reinitiates said purging means and said learning after being stopped for a predetermined time.

6. The control system recited in claim 4 wherein said learning means is responsive to an integration of a deviation between said air fuel measurement and a desired air/fuel measurement.

7. A control system for a vehicle having a fuel vapor recovery system coupled between a fuel supply system and an intake manifold of an internal combustion engine, comprising;

induction means for inducting a mixture of ambient air and liquid fuel into the air/fuel intake;

purging means coupled to the fuel supply system and the fuel vapor recovery system for periodically purging a vapor mixture of fuel vapor and purged air into the engine air/fuel intake;

adaptive learning means responsive to an air/fuel measurement of engine operation for measuring fuel vapor content in said purged vapor mixture when said adaptive learning mean sis in a first state of operation and for measuring air/fuel offsets over a range of engine operating conditions when said adaptive learning means is in a second state of operation, said adaptive learning means switching from said first stat to said second state when said measurement of fuel vapor content is less than a preselected value;

feedback means coupled to an exhaust gas oxygen sensor for providing said air/fuel measurement of inducted air and purged fuel vapors and liquid fuel, said feedback means also correcting said liquid fuel inducted into said engine in response to said air/fuel measurement and said fuel vapor content measurement and said air/fuel offset measurement; and purge control means for stopping said purging when said fuel vapor content measurement is less than said preselected value and for initiating said purging after said purging has been stopped for said preselected time.

8. The control system recited in claim 7 wherein said adaptive learning means switches from said second state to said first state said predetermined time after switching from said first state to said second state.

9. The control system recited in claim 7 wherein said range of engine operating conditions comprises a set of engine speed and load conditions.

10. The control system recited in claim 7 further comprising measurement means for providing said measurement of fuel vapor content, said measurement means integrating a deviation in said air/fuel measurement from a desired air/fuel ratio.

11. A control method for a vehicle having a fuel vapor recovery system coupled between a fuel supply system and an intake manifold of a internal combustion engine, comprising the steps of:

inducting a mixture of ambient air and liquid fuel into the air/fuel intake;

periodically purging a vapor mixture of fuel vapor and purged air from said fuel vapor recovery system into the engine air/fuel intake;

providing an air/fuel measurement of inducted air and purged fuel vapors and liquid fuel;

measuring fuel vapor content in said purged vapor mixture in response to said air/fuel measurement;

disabling said step of purging when said fuel vapor measurement is less than a predetermined value;

measuring air/fuel offsets over a range of engine operating conditions in response to said air/fuel measurement for a predetermined time after said purging is disabled and reenabling said purging step after said predetermined time; and correcting said liquid fuel inducted into said engine in response to said air/fuel measurement and said fuel vapor content measurement and said air/fuel offset measurement.

12. The method recited in claim 11 wherein said air/fuel offsets are measured at each of a plurality of engine speed and load pairs, and each of a plurality of memory locations corresponding to said engine speed and load pairs are updated with a corresponding one of said offset measurements.

13. The method recited in claim 12 wherein said correcting step further includes reading one of said air/fuel offset measurements from said memory in relation to engine speed and load conditions occurring during said correcting step.

* * * * *